US005583255A

United States Patent [19]

Biavasco et al.

[11] Patent Number: 5,583,255

[45] Date of Patent: Dec. 10, 1996

[54] YELLOW AND MAGENTA CHROMOGENIC LEUCO DYES FOR PHOTOTHERMOGRAPHIC ELEMENTS

[75] Inventors: Raffaella Biavasco; Stefano Parodi, both of Savona, Italy; Sharon M. Simpson; Kim M. Vogel, both of Lake Elmo, Minn.

[73] Assignee: Imation Corp., St. Paul, Minn.

[21] Appl. No.: 420,112

[22] Filed: Apr. 11, 1995

Related U.S. Application Data

[62] Division of Ser. No. 161,900, Dec. 3, 1993, Pat. No. 5,432,041.

[51] Int. Cl.[6] ..... G03C 1/498

[52] U.S. Cl. ..... 564/50; 544/294; 548/368.4

[58] Field of Search ..... 548/368.4; 544/294; 564/50

[56] References Cited

U.S. PATENT DOCUMENTS

| | | |
|---|---|---|
| 2,784,186 | 3/1957 | Adams et al. . |
| 3,457,075 | 7/1969 | Morgan et al. . |
| 3,531,286 | 9/1970 | Renfrew . |
| 3,839,049 | 10/1974 | Simons . |
| 3,880,658 | 4/1975 | Lestina et al. . |
| 3,985,565 | 10/1976 | Gabrielson et al. . |
| 4,187,108 | 2/1980 | Willis . |
| 4,260,677 | 4/1981 | Winslow et al. . |
| 4,374,921 | 2/1983 | Frenchik . |
| 4,426,441 | 1/1984 | Adin et al. . |
| 4,439,280 | 3/1984 | Gendler et al. . |
| 4,460,681 | 7/1984 | Frenchik . |
| 4,500,626 | 2/1985 | Naito et al. . |
| 4,551,740 | 11/1985 | Hung . |
| 4,563,415 | 1/1986 | Brown et al. . |
| 4,570,171 | 2/1986 | Hung . |
| 4,587,211 | 5/1986 | Ishida et al. . |
| 4,594,307 | 6/1986 | Ishida . |
| 4,622,395 | 11/1986 | Bellus et al. . |
| 4,647,525 | 3/1987 | Miller . |
| 4,670,374 | 6/1987 | Bellus et al. . |
| 4,708,928 | 11/1987 | Geisler . |
| 4,795,697 | 1/1989 | Vogel et al. . |
| 4,981,775 | 1/1991 | Swain et al. . |
| 5,149,807 | 9/1992 | Hammond et al. . |
| 5,330,864 | 7/1994 | Biavasco et al. ..... 430/619 |

FOREIGN PATENT DOCUMENTS

| | | |
|---|---|---|
| 0244399 | 11/1987 | European Pat. Off. . |
| 52-89131 | 7/1977 | Japan . |
| 59-5239 | 1/1984 | Japan . |

OTHER PUBLICATIONS

H. A. Lubs, The Chemistry of Synthetic Dyes and Pigments, Hafner; New York, NY, 1955; Chapter 5.

H. Zolliner, Color Chemistry: Synthesis, Properties and Applications of Organic Dyes and Pigments; VCH, New York, NY; pp. 67–73, 1987.

*Primary Examiner*—Robert Gerstl

*Attorney, Agent, or Firm*—Susan Moeller Zerull

[57] ABSTRACT

Photothermographic elements capable of producing a high density yellow or magenta image upon image-wise exposure and thermal development at a relatively low temperature and for a short period of time are described. The photothermographic elements of the invention comprise coated on a support base at least one light-sensitive emulsion layer comprising (a) a leuco dye reducing reducing agent, (b) a photosensitive silver halide, (c) an organic silver compound capable of being reduced by the leuco dye reducing agent, and (d) a binder; wherein the leuco dye reducing agent thereto comprises a chromogenic yellow or magenta leuco dye compound.

The photothermographic elements of the invention may be used to obtain yellow and magenta images of suitable density in single color or multicolor photothermographic articles. At the same time the chromogenic leuco dye is stable enough not to be oxidized by oxygen of the air or by simple heating and to limit the fog formation after development.

3 Claims, No Drawings

YELLOW AND MAGENTA CHROMOGENIC LEUCO DYES FOR PHOTOTHERMOGRAPHIC ELEMENTS

This is a division of application Ser. No. 08/161,900 filed Dec. 3, 1993, now U.S. Pat. No. 5,432,041.

BACKGROUND OF THE INVENTION

1. Field of the Invention

This invention relates to leuco dyes, and, more particularly, to yellow and magenta chromogenic leuco dyes that are suitable for use in photothermographic imaging systems.

2. Discussion of the Art

Silver halide photothermographic imaging materials (i.e., heat developable photographic materials) and that are classified as "dry silver" compositions or emulsions, and are processed with heat and without liquid development and have been known in the art for many years. Such materials comprise (1) a light-insensitive, reducible silver source, (2) a light-sensitive material that generates atomic silver when irradiated, and (3) a reducing agent for the reducible silver source. The light-sensitive material is generally photographic silver halide, which must be in catalytic proximity to the light-insensitive, reducible silver source. Catalytic proximity requires an intimate physical association of these two materials so that when silver specks or nuclei are generated by the irradiation or light exposure of the photographic silver halide, those nuclei are able to catalyze the reduction of the reducible silver source. It has long been understood that atomic silver (Ag°) is a catalyst for the reduction of silver ions, and the light-sensitive photographic silver halide may be placed into catalytic proximity with the light-insensitive, reducible silver source in a number of different fashions, such as partial metathesis of the reducible silver source with a halogen-containing source (see, for example, U.S. Pat. No. 3,457,075), coprecipitation of silver halide and reducible silver source material (see, for example, U.S. Pat. No. 3,839,049), blending, and other methods that intimately associate the light-sensitive photographic silver halide and the light-insensitive, reducible silver source.

The light-insensitive, reducible silver source is a material that contains silver ions. The preferred light-insensitive reducible silver source comprises silver salts of long chain aliphatic carboxylic acids, typically having from 10 to 30 carbon atoms. The silver salt of behenic acid or mixtures of acids of similar molecular weight are generally used. Salts of other organic acids or other organic materials, such as silver imidazolates have been proposed, and U.S. Pat. No. 4,260,677 discloses the use of complexes of inorganic or organic silver salts as light-insensitive, reducible silver sources.

In both photographic and photothermographic emulsions, exposure of the photographic silver halide to light produces small clusters of silver atoms (Ag°). The imagewise distribution of these clusters is known in the art as a latent image. This latent image generally is not visible by ordinary means and the light-sensitive emulsion must be further processed in order to produce a visible image. The visible image is produced by the reduction of silver ions, which are in catalytic proximity to silver halide grains bearing the clusters of silver atoms, i.e. the latent image.

As the visible image is produced entirely by silver atoms (Ag°), one cannot readily decrease the amount of silver in the emulsion without reducing the maximum image density. However, reduction of the amount of silver is desirable in order to reduce the cost of raw materials used in the emulsion.

One conventional way of attempting to increase the maximum image density of photographic and photothermographic emulsions without increasing the amount of silver in the emulsion layer is by incorporating dye-forming materials in the emulsion. Such dye-forming materials include leuco dyes, which are the reduced form of a color-bearing dye. Upon imaging, the leuco dye is oxidized, and the color-bearing dye and a reduced silver image are simultaneously formed in the exposed region. In this way a dye enhanced silver image can be produced, as shown for example in U.S. Pat. Nos. 3,531,286; 4,187,108; 4,426,441; 4,374,921; and 4,460,681. However, when the reactants and reaction products of photothermographic systems that contain leuco dyes remain in contact after imaging, several problems can result. For example, thermal development often forms turbid and hazy color images because of dye contamination of the reduced metallic silver image on the exposed area of the emulsion. In addition, the resulting prints tend to develop color in unimaged background areas. This "background stain" is caused by slow reaction between the leuco dye and reducing agent during storage.

Multicolor photothermographic imaging articles typically comprise two or more monocolor-forming emulsion layers (often each emulsion layer comprises a set of bilayers containing the color-forming reactants) maintained distinct from each other by barrier layers. The barrier layer overlaying one photosensitive, photothermographic emulsion layer typically is insoluble in the solvent of the next photosensitive, photothermographic emulsion layer. Photothermographic articles having at least 2 or 3 distinct color-forming emulsion layers are disclosed in U.S. Pat. Nos. 4,021,240 and 4,460,681. Various methods to produce dye images and multicolor images with photographic color couplers and leuco dyes are well known in the art as represented by U.S. Pat. Nos. 4,022,617; 3,531,286; 3,180,731; 3,761,270; 4,460,681; 4,883,747 and Research Disclosure 29963.

A common problem that exists with these photothermographic systems is the instability of the image following processing. The photoactive silver halide still present in the developed image may continue to catalyze print-out of metallic silver even during room light handling causing a strong increase of fog after development. This is also increased by the presence of oxygen in the air which causes the oxidation of leuco dyes. For example, U.S. Pat. Nos. 4,670,374 and 4,889,932 describe photothermographic materials containing oxidable leuco phenazine, phenoxazine or phenothiazine dyes useful to give color photothermographic images. Unfortunately they are subjected to aerial oxidation, which causes increasing fog after development.

Another problem is the lack of stability of the leuco dyes before exposure: in fact, in many cases, it is not possible to obtain any images because the leuco dye reacts in a non-image-wise way before exposure. The consequence of this non-image-wise reaction is the absence of sensitometric effects. This means that there is no difference in the print-out between the parts that should have produced an image and the parts that should not have produced any image. European Patent Application No. 35,262, and PCT Patent application No. WO 90-00,978 describe, respectively, non-silver copy materials and non-silver heat-sensitive materials both having leuco dyes with the same —$SO_2$— protecting group. These leuco dyes are useful in heat-sensitive materials. They are not useful in photothermographic materials because they do not react image-wise to give a dye image. In fact, when the material containing such leuco dyes is exposed and developed according to the usual process for photothermographic materials, it does not present any sensitometric effects.

Thus, there exists a need to have useful leuco dyes for photothermographic materials which are stable enough not to be oxidised by contact with air or by simple heating, and which limit fog formation after development to the simple print-out due to the presence of photosensitive silver halide. They also must react image-wise to provide a good dye image.

British Patent No. GB 1,417,586 describes the preparation of oxichromic compounds containing a reduced azomethine linkage. Such compounds produce upon chromogenic oxidation a chromophore useful in colour photographic systems, particularly in silver halide transfer materials. These oxichromic compounds may have a group which prevents oxidation of the N atom of the azomethine linkage and which hydrolizes off in alkaline solution and, in addition, they have a hydroquinone moiety in their structures. They are hence different from the compounds of the present invention and are used for a different purpose.

A number of methods have been proposed for obtaining colour images with dry silver systems. Such methods include incorporated coupler materials, e.g., a combination of silver benzotriazole, well known magenta, yellow and cyan dye-forming couplers, aminophenol developing agents, a base release agent such as guanidinium trichloroacetate and silver bromide in poly(vinyl butyral); a combination of silver bromoiodide, sulphonamidophenol reducing agent, silver behenate, poly(vinyl butyral), an amine such as n-octadecylamine and 2-equivalent or 4-equivalent cyan, magenta or yellow dye-forming couplers; incorporating leuco dye bases which oxidizes to form a dye image, e.g., Malechite Green, Crystal Violet and pararosaniline; a combination of in situ silver halide, silver behenate, 3-methyl1-phenylpyrazolone and N,N-dimethyl-p-phenylenediamine hydrochloride; incorporating phenolic leuco dye reducing agents such as 2-(3,5-di-tert-butyl-4-hydroxyphenyl)-4,5-diphenylimidazole, and bis-(3,5-di-t-butyl-4-hydroxyphenyl)phenylmethane, incorporating azomethine dyes or azo dye reducing agents; silver dye bleach process, e.g., an element comprising silver behenate, behenic acid, poly(vinyl butyral), poly(vinyl-butyral)peptized silver bromoiodide emulsion, 2,6-dichloro-4-benzenesulfonamidophenol, 1,8-(3,6-diazaoctane)bis-isothiuronium-p-toluene sulfonate and an azo dye which was exposed and heat processed to obtain a negative silver image with a uniform distribution of dye which was laminated to an acid activator sheet comprising polyacrylic acid, thiourea and p-toluene sulfonic acid and heated to obtain well defined positive images; and incorporating amines such as amino acetanilide (yellow dye-forming) 3,3'-dimethoxybenzidine (blue dye-forming) or sulfanilanilide (magenta dye forming) which react with the oxidized form of incorporated reducing agents such as 2,6-dichloro-4-benzene-sulfonamido-phenol to form dye images. Neutral dye images can be obtained by the addition of amines such as behenylamine and p-anisidine.

Leuco dye oxidation in such silver halide systems are disclosed in U.S. Pat. Nos. 4,021,240, 4,374,821, 4,460,681 and 4,883,747.

SUMMARY OF THE INVENTION

In one aspect, the present invention provides heat-developable, photothermographic elements capable of providing stable, high density, yellow and magenta color images of high resolution. These elements comprise a support bearing at least one light sensitive image-forming photothermographic emulsion layer composition comprising:

(a) a yellow forming or magenta forming leuco dye reducing agent, (b) a photosensitive silver halide, (c) an organic silver compound, capable of being reduced by the leuco dye reducing agent, and (d) a binder, wherein said emulsion layer or an adjacent layer thereto comprises a chromogenic yellow and magenta leuco dye.

The leuco dye reducing agent comprises a chromogenic magenta or yellow leuco dye compound having a central nucleus of the general formula:

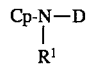

or a magenta of yellow chromogenic leuco dye compound having a central nucleus of the formulae I or II.

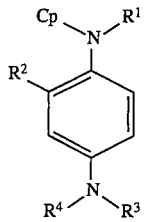

I or

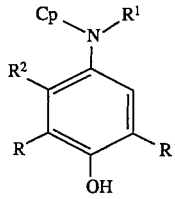

II wherein $NH_2D$ is a color photographic developer (so that D is the residue of a color photographic developer from which $NH_2$— has been removed);

R is hydrogen or halogen (in order of preference Cl, Br, F, and I);

$R^1$, is a —CONH—$R^5$ group, a —CO—$R^5$ group or a —CO—O—$R^5$ group, and $R^5$ is an alkyl group (e.g., of from 1 to 20 carbon atoms), or an aryl group (e.g., of at least 4 carbon atoms or from 6 to 30 carbon atoms) or may be a ballasting (e.g., high molecular weight) group;

$R^2$ is a hydrogen atom or an alkyl group of from 1 to 4 carbon atoms;

$R^3$ and $R^4$ are each independently selected from, a hydrogen atom, an alkyl group of from 1 to 4 carbon atoms, a —X—Y group, wherein X is an alkylene group of from 1 to 4 carbon atoms, and Y is a cyano group, a halogen atom, or —OH; or —$NHSO_2$—Z, wherein Z is an alkyl group (e.g., of 1 to 20 carbon atoms; and Cp is a photographic coupler group.

In the present invention, the preferred chromogenic yellow and magenta leuco dyes may be represented by compounds having a central nucleus of the general formula III:

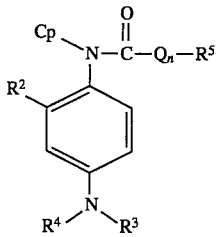

III wherein $R^2$, $R^3$, $R^4$, $R^5$ and Cp have the same meaning as defined n formula (I);

Q is —NH— or —O—;

and n is 0 or 1.

In another aspect, the present invention provides novel yellow and magenta chromogenic leuco dyes capable of providing stable, high density, yellow and magenta images.

In yet another aspect, the present invention provides a process for producing images using these yellow and magenta chromogenic leuco dyes.

The photothermographic elements of the present invention may be used to obtain good yellow or magenta images of suitable density in single colour or multicolour photothermographic articles. At the same time, the chromogenic leuco dye is stable enough not to be oxidised by oxygen of the air or by simple heating and to limit the fog formation after development.

As is well understood in this technical area, a large degree of substitution is not only tolerated, but is also often advisable. As a means of simplifying the description of substituent groups, the terms "group" and "moiety" are used to differentiate between those chemical species that may be substituted and those which may not be so substituted. Thus, when the term "group," "aryl group," or "central nucleus" is used to describe a substituent, that substituent includes the basic group and the basic group containing conventional substitution. Where the term "moiety" is used to describe a substituent, only the unsubstituted group is intended to be included. For example, the phrase, "alkyl group" is intended to include not only pure hydrocarbon alkyl chains, such as methyl, ethyl, propyl, t-butyl, cyclohexyl, iso-octyl, octadecyl and the like, but also alkyl chains bearing substituents known in the art, such as hydroxyl, alkoxy, phenyl, halogen atoms (F, Cl, Br, and I), cyano, nitro, amino, carboxy, etc. On the other hand, the phrase "alkyl moiety" is limited to the inclusion of only pure hydrocarbon alkyl chains, such as methyl, ethyl, propyl, t-butyl, cyclohexyl, iso-octyl, octadecyl, and the like.

DETAILED DESCRIPTION OF THE INVENTION

The term "emulsion layer" means a layer of a photothermographic element that contains light-sensitive silver salt and silver source material.

According to the present invention, the photothermographic element comprises coated on a support base at least one light-sensitive emulsion layer comprising:

(a) a yellow or magenta leuco dye reducing agent, (b) a photosensitive silver halide, (c) an organic silver compound, capable of being reduced by the leuco dye reducing agent, and (d) a binder, wherein the leuco dye reducing agent comprises a chromogenic leuco dye compound represented by the formula

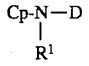

and is more specifically represented by the general formulae I or II:

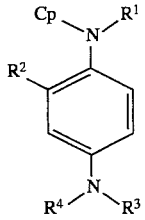

I or

-continued

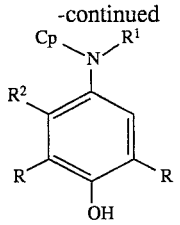

II wherein; R is hydrogen or halogen (preferably Cl);

$R^1$, is a —CONH—$R^5$ group, a —CO—$R^5$ group or a —CO—O—$R^5$ group, and $R^5$ is an alkyl group (e.g., of from 1 to 20 carbon atoms), or an aryl group (e.g., of from 6 to 30 carbon atoms); or $R^5$ may be a ballasting group (e.g., high molecular weight group);

$R^2$ is a hydrogen atom or an alkyl group of from 1 to 4 carbon atoms;

$R^3$ and $R^4$ are each independently selected from, a hydrogen atom, an alkyl group of from 1 to 4 carbon atoms, a —X—Y group, wherein X is an alkylene group of from 1 to 4 carbon atoms, and Y is a cyano group, a halogen atom, —OH or a —$NHSO_2$—Z group, wherein Z is an alkyl group (e.g., of from 1 to 20 carbon atoms);

$NH_2D$ is a color photographic developing agent (developer, e.g., primary aromatic amine color photographic developer); and and Cp is a photographic coupler group;

In Formula II, novel cyan dyes are also available by selecting a cyan leuco chromogenic dye. These can be made by substantially similar synthetic procedures as the dyes of Formula I using appropriate reagents.

In Formula I, $R^1$ is a —CONH—$R^5$ group, a —CO—$R^5$, group or a —CO—O—$R^5$. $R^5$ may be an alkyl group, linear or branched, and preferably containing 1 to 20 carbon atoms, more preferably 1 to 8 carbon atoms or an aryl group of from 6 to 30 carbon atom. Examples of $R^5$ include methyl, ethyl, propyl, butyl, t-butyl, etc. Examples of $R^5$ of Formula (I) when $R^5$ is an aryl group include a phenyl group, a naphthyl group, or other aryl group of up to 30 carbon atoms. Preferrably $R^5$ is a phenyl group. This group is allowed to have a single substituent or a plurality of substituents; for example, typical substituents introducible to the aryl group include halogen atoms (such as fluorine, chlorine, bromine, etc.), alkyl groups (such as methyl, ethyl, propyl, butyl, dodecyl, etc.), hydroxyl group, cyano group, nitro group, alkoxy groups (such as methoxy, ethoxy, etc.), alkylsulfonamido groups (such as methylsulfonamido, octylsulfonamido, etc.), arylsulfonamido groups (such as phenylsulfonamido, naphthylsulfonamido, etc.), alkylsulfamoyl groups (such as butylsulfamoyl), arylsulfamoyl (such as phenylsulfamoyl), alkyloxycarbonyl groups (such as methyloxycarbonyl), aryloxycarbonyl groups (such as phenyloxycarbonyl), aminosulfonamido groups, acylamino groups, carbamoyl groups, sulfonyl groups, sulfinyl groups, sulfoxy groups, sulfo groups, aryloxy groups, alkoxy groups, alkylcarbonyl groups, arylcarbonyl groups, aminocarbonyl groups, and the like. Two different members of these groups may be introduced to the aryl group. The preferred group represented by $R^5$ is a phenyl group.

$R^2$ is a hydrogen atom, or an alkyl group of from 1 to 4 carbon atoms. Examples of $R^2$ include methyl, ethyl, propyl, i-propyl, butyl, and t-butyl.

$R^3$ and $R^4$ are each independently selected from, a hydrogen atom, an alkyl group of from 1 to 4 carbon atoms, a —X—Y group, wherein X is an alkylene group of from 1 to 4 carbon atoms, and Y is a cyano group, a halogen atom, or —OH. Examples of $R^3$ and $R^4$ include methyl, ethyl, allyl, cyanoethyl, hydroxyethyl, etc.

In the present invention, the preferred chromogenic yellow and magenta leuco dyes are compounds having Formula III.

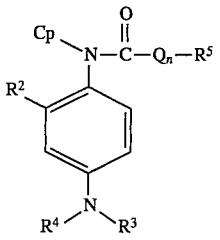

III wherein $R^2$, $R^3$, $R^4$, $R^5$and Cp have the same meaning as defined in formula (I);

Q is —NH— or —O—; and n is 0 or 1.

In the present invention, the most preferred chromogenic yellow and magenta leuco dyes are the compounds having Formula (IV).

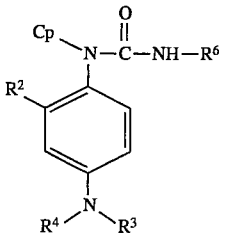

IV wherein $R^2$, $R^3$, $R^4$, and Cp have the same meaning as defined in formula (I);

$R^6$ is an alkyl group of up to 8 carbon atoms (such as methyl, ethyl, propyl, butyl, etc.) or an aryl group (such as phenyl, naphthyl, p-aminophenyl, etc. up to 30 carbon atoms), or a ballasting organic group.

As noted above, Cp is a photographic coupler group. The term photographic coupler group has an accepted meaning within the photographic art. Couplers are materials that when reacted with an oxidized color photographic developer (e.g., p-phenylenediamine and its derivatives) couples with the oxidized developer (the coupler itself being oxidized in this reaction) and forms a dye. The "coupler group" is that portion of the coupler remaining after reaction with the oxidized developer. The coupler group, as compared to the coupler, will have the developer residue bonded to the coupler group at a position on the coupler previously occupied by a hydrogen atom or other splitting-off group at the coupling portion of the coupler.

Examples of couplers useful in the present invention are described in T. H. James *The Theory of the Photographic Process*, Fourth Edition, 1977, Macmillian, N.Y. Further examples of couplers useful in the present invention are disclosed in U.S. Pat. Nos. 4,426,441 and 4,469,773 incorporated herein by reference. Representative couplers are shown in Table I:

TABLE I

| Representative Couplers |
|---|
| Magenta Couplers |
| 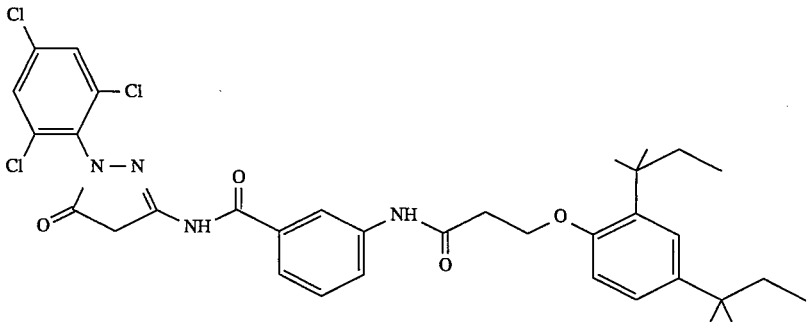 Coupler A |
| 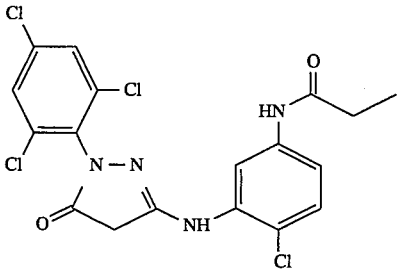 Coupler B |

TABLE I-continued
| Representative Couplers | |
|---|---|
| 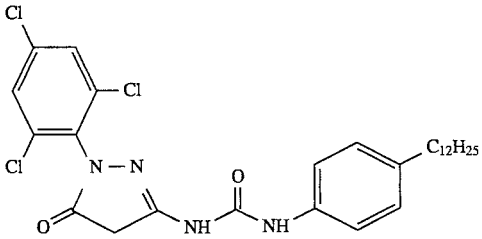 | Coupler C |
| 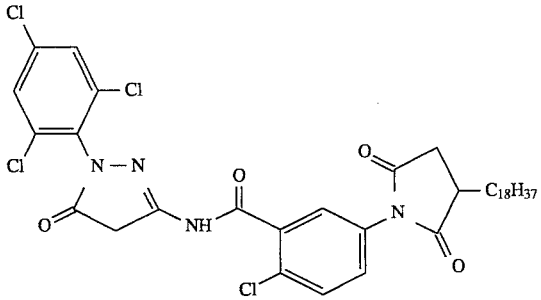 | Coupler D |
| 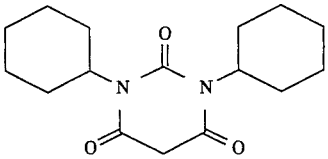 | Coupler E |
| Yellow Couplers | |
| 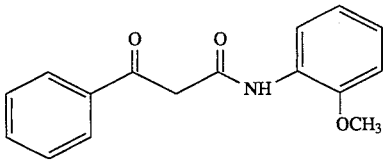 | Coupler F |
| 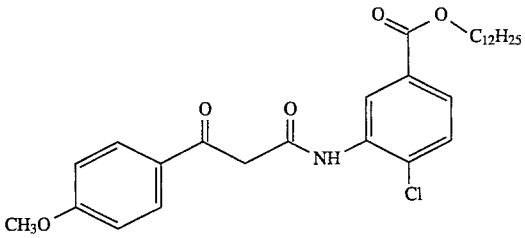 | Coupler G |
| 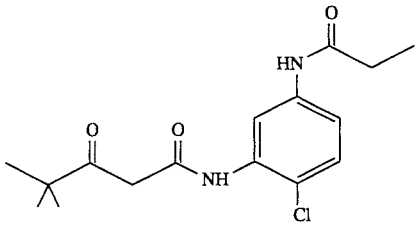 | Coupler H |
| 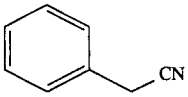 | Coupler J |

Examples of developers useful in the present invention are described in T. H. James *The Theory of the Photographic Process*, Fourth Edition, 1977, Macmillan, N.Y; Chapter 12, pages 353 to 354. Preferred developers are those derived from p-phenylenediamines and p-aminophenols. Representative developers are shown in Table II.

TABLE II

Representative Developers

Developer A

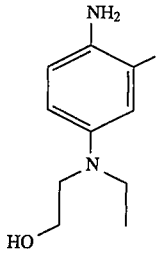

Developer B

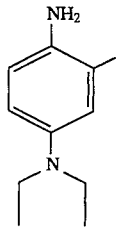

Developer C

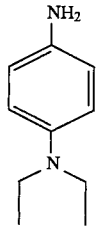

TABLE II-continued

Representative Developers

Developer D

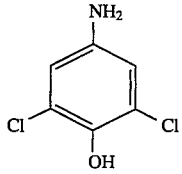

The yellow and magenta leuco dyes of the present invention may be prepared by two methods. In the first method, a coupler and a developer may be oxidatively reacted to form a chromogenic dye. Reduction of this dye, as for example, using a palladium on carbon catalyst forms the "hydrogen leuco dye." Reaction of this "hydrogen leuco dye" with a "blocking reagent" forms the chromogenic leuco dye. Scheme I exemplifies this route to form Leuco Dye B, using Coupler A as the coupler, 2-methyl-N-ethyl-N-(2-hydroxyethyl)-p-phenylenediamine (Developer A) as the developer, and 4-(N,N-dimethylamino)phenylisocyanate as the "blocking reagent."

In the second method, a developer and a "blocking reagent" may be reacted to first form a "blocked developer." Oxidative reaction of this "blocked developer" with a coupler forms the chromogenic leuco dye. Scheme II exemplifies this route to form Leuco Dye G, using Coupler F as the coupler and 1-n-butyl-3-(4'-N,N-diethylamino)phenyl urea as the "blocked developer." 1-n-butyl-3-(4'-N,N-diethylamino)phenyl urea is prepared by reaction of n-butylamine with with 4-(N,N-diethylamino)phenylisocyanate.

Scheme I

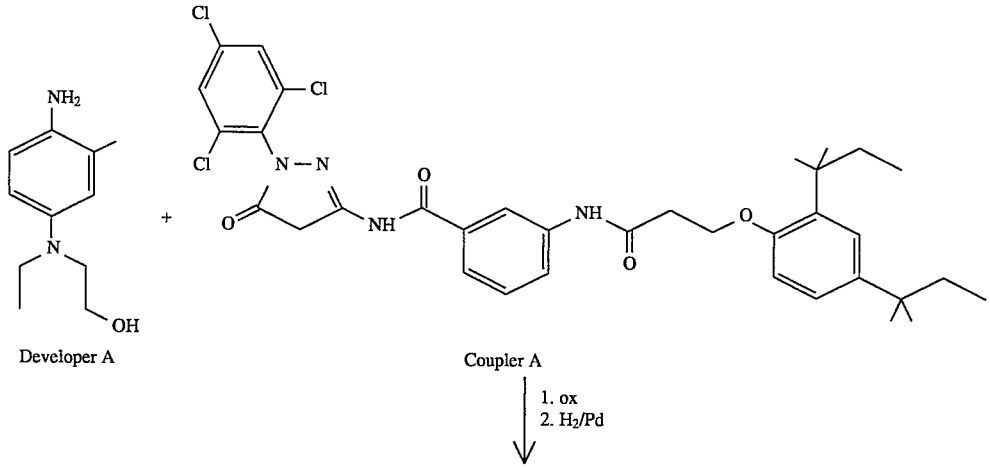

-continued

Scheme I

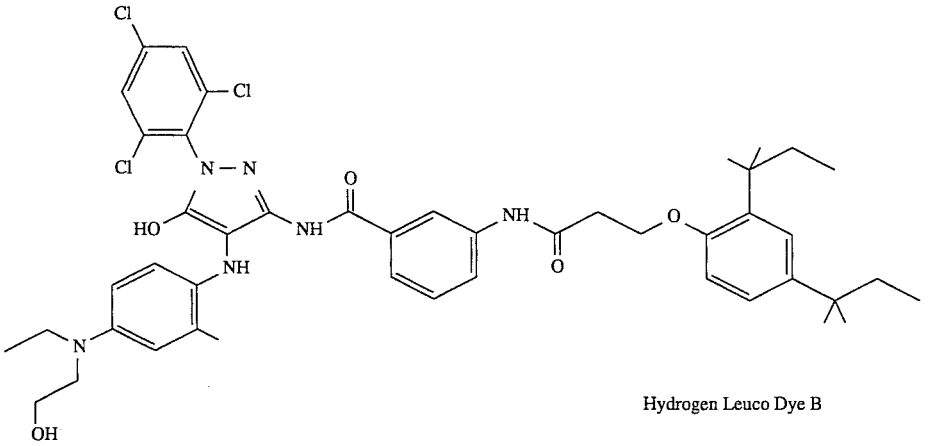

Hydrogen Leuco Dye B

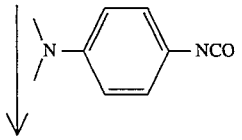

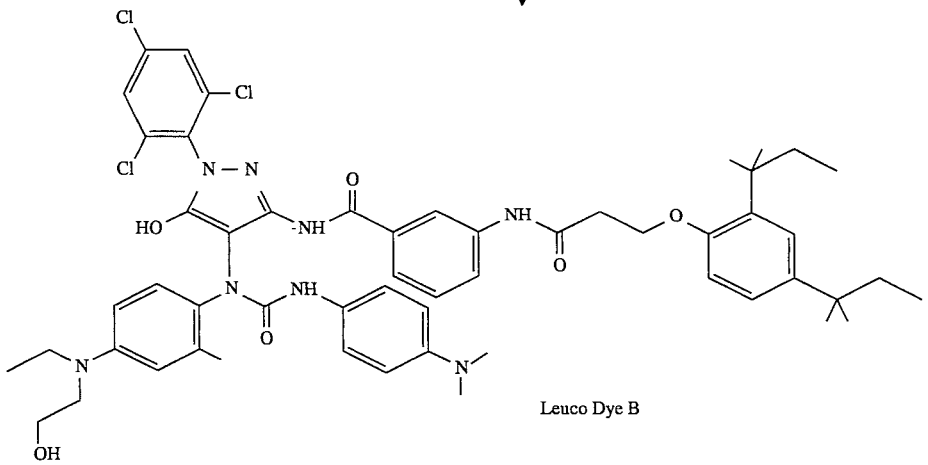

Leuco Dye B

Scheme II

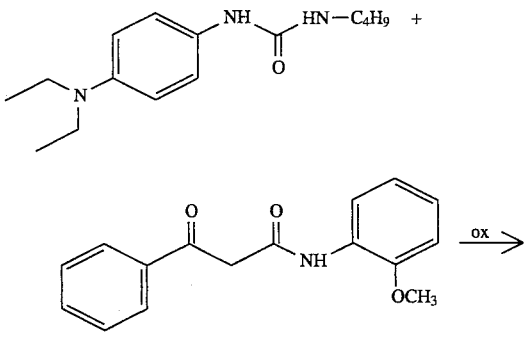

Coupler F

-continued

Scheme II

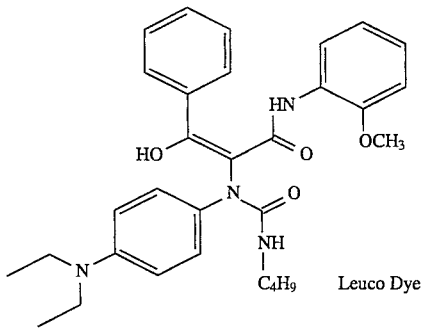

Leuco Dye G

In the present invention, representative chromogenic yellow and magenta leuco dyes of Formulae I–IV are shown below in Table III. These representations are exemplary and are not intended to be limiting. These exemplified compounds may be readily synthesized as shown later herein.

TABLE III
Representative Chromogenic Leuco Dyes
Leuco Dye A
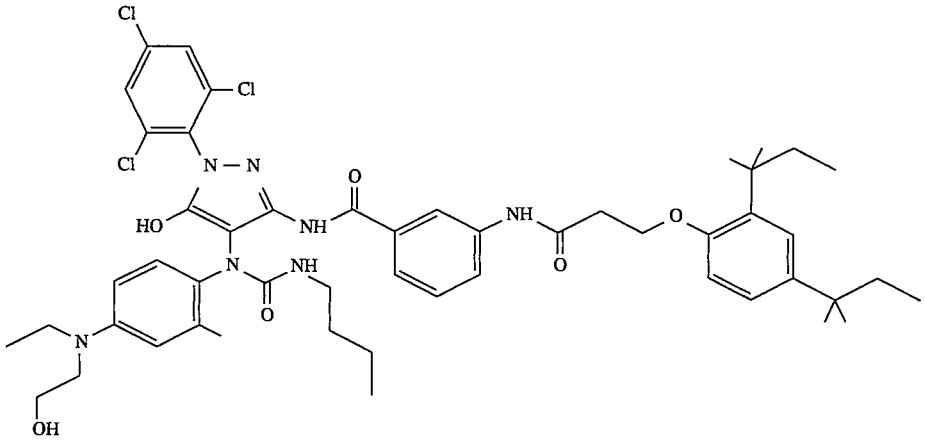
Leuco Dye B
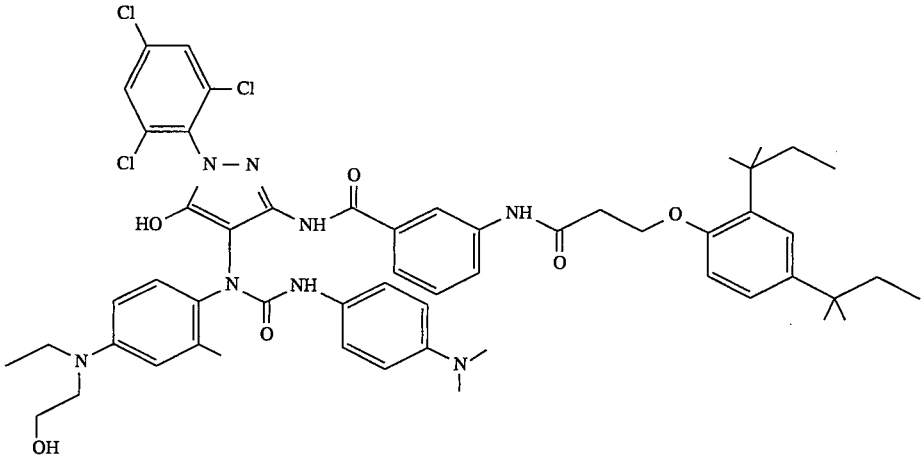
Leuco Dye C
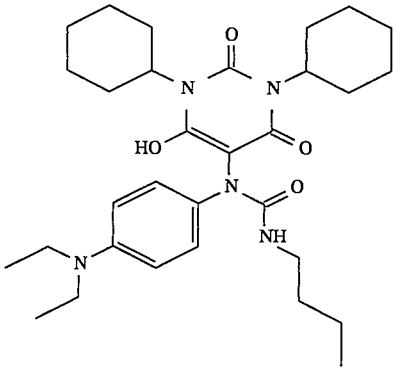

TABLE III-continued
| Representative Chromogenic Leuco Dyes | |
|---|---|
| 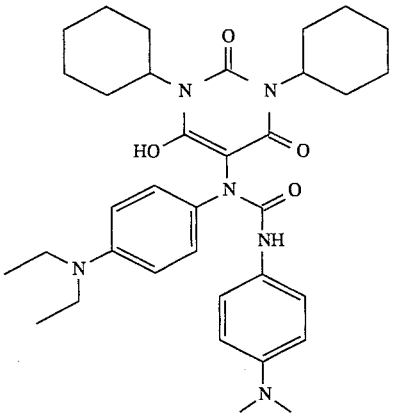 | Leuco Dye D |
| 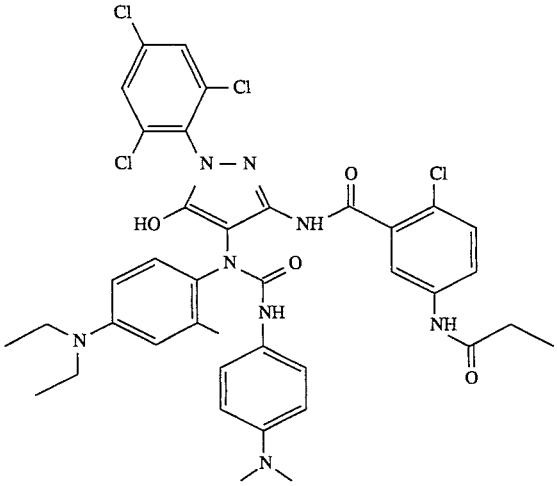 | Leuco Dye E |
| 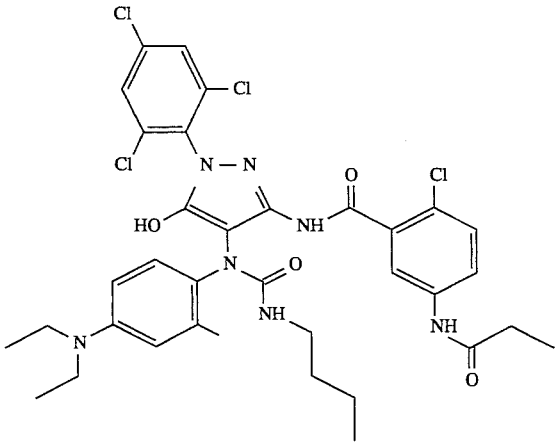 | Leuco Dye F |

TABLE III-continued
| Representative Chromogenic Leuco Dyes | |
|---|---|
| 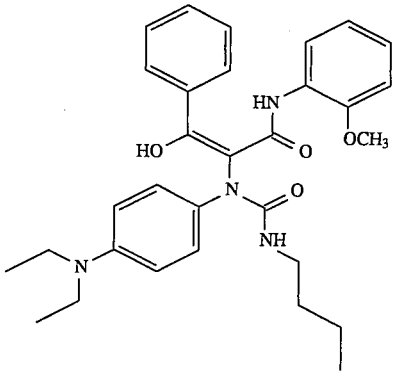 | Leuco Dye G |
| 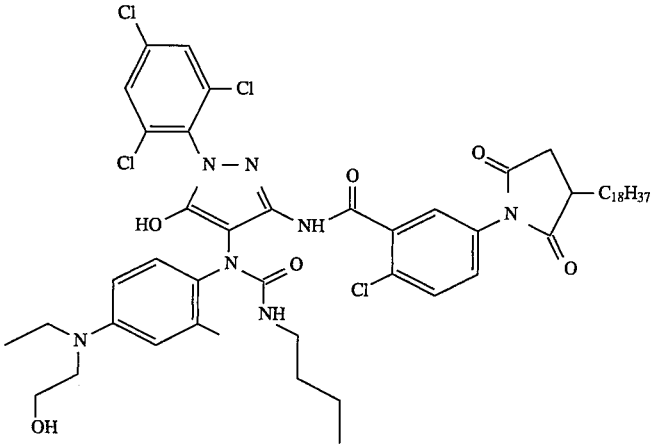 | Leuco Dye H |
| 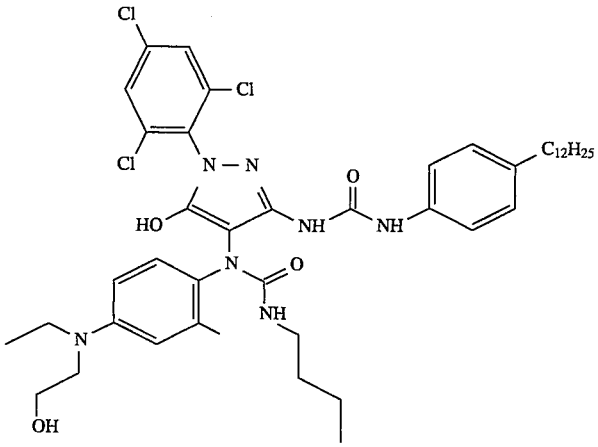 | Leuco Dye J |

TABLE III-continued

| Representative Chromogenic Leuco Dyes | |
|---|---|
| 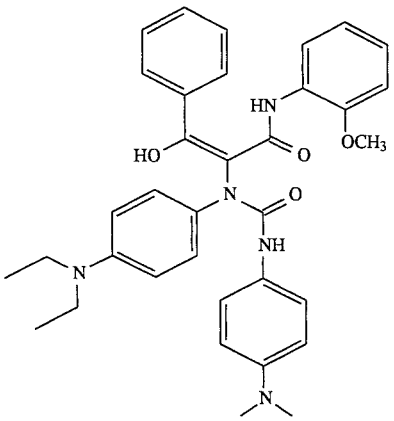 | Leuco Dye K |

The amounts of the above described compounds, which are added according to the present invention to at least one light-sensitive emulsion layer or to an adjacent layer, can be varied depending upon the particular compound used and upon the type of emulsion used. However, they are preferably added in an amount of $10^{-3}$ to 100 mol, and more preferably from $10^{-2}$ to 10 mol, per mol of silver halide in the emulsion layer.

The Photosensitive Silver Halide

The photosensitive silver halide can be any photosensitive silver halide, such as silver bromide, silver iodide, silver chloride, silver bromoiodide, silver chlorobromoiodide, silver chlorobromide, etc. The photosensitive silver halide can be added to the emulsion layer in any fashion so long as it is placed in catalytic proximity to the organic silver compound which serves as a source of reducible silver.

The light sensitive silver halide used in the present invention can be employed in a range of 0.005 mole to 0.5 mole and, preferably, from 0.01 mole to 0.15 mole per mole of silver salt. The silver halide may be added to the emulsion layer in any fashion which places it in catalytic proximity to the silver source.

The silver halide used in the present invention may be employed without modification. However, it can be chemically and spectrally sensitized in a manner similar to that used to sensitize conventional wet process silver halide or heat-developable photographic materials. For example, it may be chemically sensitized with a chemical sensitizing agent such as a compound containing sulfur, selenium or tellurium etc., or a compound containing gold, platinum, palladium, ruthenium, rhodium or iridium, etc., a reducing agent such as a tin halide, etc., or a combination thereof. The details of these procedures are described in T. H. James *The Theory of the Photographic Process*, Fourth Edition, Chapter 5, pages 149 to 169. Suitable chemical sensitization procedures are also described in Shepard, U.S. Pat. No. 1,623,499; Waller, U.S. Pat. No. 2,399,083; McVeigh, U.S. Pat. No. 3,297,447; and Dunn, U.S. Pat. No. 3,297,446.

The photosensitive silver halides may be spectrally sensitized with various known dyes that spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. Of these dyes, cyanine dyes, merocyanine dyes, and complex merocyanine dyes are particularly useful.

An appropriate amount of sensitizing dye added is generally in the range of from about $10^{-10}$ to $10^{-1}$ mole, and preferably from about $10^{-8}$ to $10^{-3}$ mol of silver halide.

The Light-Insensitive Silver Source Material

The light-insensitive, reducible silver source can be any material that contains a source of reducible silver ions. Silver salts of organic acids, particularly silver salts of long chain fatty carboxylic acids, are preferred. The chains typically contain 10 to 30, preferably 15 to 28 carbon atoms. Complexes of organic or inorganic silver salts, wherein the ligand has a gross stability constant for silver ion of between 4.0 and 10.0, are also useful in this invention. The source of reducible silver material generally constitutes from 20 to 70 percent by weight of the emulsion layer. It is preferably present at a level of 30 to 55 percent by weight of the emulsion layer.

The organic silver salt which can be used in the present invention is a silver salt which is comparatively stable to light, but forms a silver image when heated to 80° C. or higher in the presence of an exposed photocatalyst (such as silver halide) and a reducing agent.

Suitable organic silver salts include silver salts of organic compounds having a carboxy group. Preferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myrristate, silver palmitate, silver maleate, silver fumarate, silver tartarate, silver furoate, silver linoleate, silver butyrate and silver camphorate, mixtures thereof, etc. Silver salts which are substitutable with a halogen atom or a hydroxyl group can also be effectively used. Preferred examples of the silver salts of aromatic carboxylic acid and other carboxyl group-containing compounds include silver benzoate, a silver substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tanhate, silver phthalate, silver terephthalate, silver salicylate, silver phenylacetate, silver pyromellilate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663.

Silver salts of compounds containing mercapto or thione groups and derivatives thereof can be used. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(2-ethylglycolamido)benzothiazole, a silver salt of thioglycolic acid such as a silver salt of a S-alkylthioglycolic acid (wherein the alkyl group has from 12 to 22 carbon atoms) as described in Japanese patent application No. 28221/73, a silver salt of a dithiocarboxylic acid such as a silver salt of dithioacetic acid, a silver salt of thioamide, a silver salt of 5-carboxylic-1-methyl-2-phenyl-4-thiopyridine, a silver salt of mercaptotriazine, a silver salt of 2-mercaptobenzoxazole, a silver salt as described in U.S. Pat. No. 4,123,274, for example, a silver salt of 1,2,4-mercaptothiazole derivative such as a silver salt of 3-amino-5-benzylthio-1,2,4-thiazole, a silver salt of a thione compound such as a silver salt of 3-(2-carboxyethyl)-4-methyl-4-thiazoline-2-thione as disclosed in U.S. Pat. No. 3,201,678.

Furthemore, a silver salt of a compound containing an imino group can be used. Preferred examples of these compounds include a silver salt of benzothiazole and a derivative thereof as described in Japanese patent publications Nos. 30270/69 and 18146/70, for example, a silver salt of benzothiazole such as silver salt of methylbenzotriazole, etc., a silver salt of a halogen substituted benzotriazole, such as a silver salt of 5-chlorobenzotriazole, etc., a silver salt of 1,2,4-triazole, of 1-H-tetrazole as described in U.S. Pat. No. 4,220,709, a silver salt of imidazole and an imidazole derivative, and the like.

It is also found convenient the use of silver half soaps, of which an equimolar blend of silver behenate and behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about 4 or 5 percent of free behenic acid and analyzing about 25.2 percent silver may be used.

The method used for making silver soap dispersions is well known in the art and is disclosed in *Research Disclosure* April 1983 (22812), *Research Disclosure* October 1983 (23419) and U.S. Pat. No. 3,985,565.

The silver halide and the organic silver salt which are separately formed in a binder can be mixed prior to use to prepare a coating solution, but it is also effective to blend both of them in a ball mill for a long period of time. Further, it is effective to use a process which comprises adding a halogen-containing compound in the organic silver salt prepared to partially convert the silver of the organic silver salt to silver halide.

Methods of preparing these silver halide and organic silver salts and manners of blending them are described in Research Disclosures, No. 170-29, Japanese patent applications No. 32928/75 and 42529/76, U.S. Pat. No. 3,700,458, and Japanese patent applications Nos. 13224/74 and 17216/75.

Preformed silver halide emulsions in the material of this invention can be unwashed or washed to remove soluble salts. In the latter case the soluble salts can be removed by chill-setting and leaching or the emulsion can be coagulation washed, e.g., by the procedures described in Hewitson, et al., U.S. Pat. No. 2,618,556; Yutzy et al., U.S. Pat. No. 2,614,928; Yackel, U.S. Pat. No. 2,565,418; Hart et al., U.S. Pat. No. 3,241,969; and Waller et al., U.S. Pat. No. 2,489,341. The silver halide grains may have any crystalline habit including, but not limited to cubic, tetrahedral, orthorhombic, tabular, laminar, platelet, etc.

Photothermographic emulsions containing preformed silver halide in accordance with this invention can be sensitized with chemical sensitizers, such as with reducing agents; sulfur, selenium or tellurium compounds; gold, platinum or palladium compounds, or combinations of these. Suitable chemical sensitization procedures are described in Shepard, U.S. Pat. No. 1,623,499; Waller, U.S. Pat. No. 2,399,083; McVeigh, U.S. Pat. No. 3,297,447; and Dunn, U.S. Pat. No. 3,297,446.

The Binder

It is preferred that the binder be sufficiently polar to hold the other ingredients of the emulsion in solution. It is preferred that the binder be selected from polymeric materials, such as, for example, natural and synthetic resins, such as gelatin, polyvinyl acetals, polyvinyl chloride, polyvinyl acetate, cellulose acetate, polyolefins, polyesters, polystyrene, polyacrylonitrile, polycarbonates, methacrylate copolymers, maleic anhydride ester copolymers, butadiene-styrene copolymers, and the like. Copolymers, e.g. terpolymers, are also included in the definition of polymers. The polyvinyl acetals, such as polyvinyl butyral and polyvinyl formal, and vinyl copolymers such as polyvinyl acetate and polyvinyl chloride are particularly preferred. The binders are generally used at a level of from about 20 to about 75 percent by weight of the emulsion layer, and preferably from about 30 to about 55 percent by weight. Where the proportions and activities of leuco dyes require a particular developing time and temperature, the binder should be able to withstand those conditions. Generally, it is preferred that the binder not decompose or lose its structural integrity at 200° F. (90° C.) for 30 seconds, and more preferred that it not decompose or lose its structural integrity at 300° F. (149° C.) for 30 seconds.

Optionally these polymers may be used in combination of two or more thereof. Such a polymer is used in an amount sufficient to carry the components dispersed therein, that is, within the effective range of the action as the binder. The effective range can be appropriately determined by one skilled in the art. As a guide in the case of carrying at least an organic silver salt, it can be said that a preferable ratio of the binder to the organic silver salt ranges from 15:1 to 1:2, and particularly from 8:1 to 1:1.

Dry Silver Formulations

The formulation for the photothermographic emulsion layer can be prepared by dissolving the photosensitive silver halide, the source of reducible silver, the leuco dye, optional additives, and the binder in an inert organic solvent, such as, for example, acetone, 2-butanone or tetrahydrofuran.

The use of "toners" or derivatives thereof which improve the image, is highly desirable, but is not essential to the element. Toners may be present in amounts of from 0.01 to 10 percent by weight of the emulsion layer, prefertable 0.1 to 10 percent by weight. Toners are well known materials in the photothermographic art as shown in U.S. Pat. Nos. 3,080,254; 3,847,612; and 4,123,282.

Examples of toners include phthalimide and N-hydroxyphthalimide; cyclic imides such as succinimide, pyrazoline-5-ones, and a quinazolinone, 1-phenylurazole, 3-phenyl-2-pyrazoline-5-one, quinazoline and 2,4-thiazolidinedione; naphthalimides such as N-hydroxy-1,8-naphthalimide; cobalt complexes such as cobaltic hexamine trifluoroacetate; mercaptans as illustrated by 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboximides, e.g. (N-dimethylaminomethyl)phthalimide, and N-(dimethylaminonmethyl)naphthalene-2,3-dicarboximide; and a combination of blocked pyrazoles, isothiuronium derivatives and certain photobleach agents, e.g., a combination of N,N'-hexamethylene bis(1-carbamoyl-3,5-dimethylpyrazole), 1,8-(3,6-diazaoctane)bis(isothiuronium)trifluoroacetate and 2-(tribromomethylsulfonyl benzothiazole); and merocyanine dyes such as 3-ethyl-5 [(3-ethyl-2-benzothiazolinylidene)-1-methyl-ethylidene]-2-thio-2,4-o-azolidinedione; phthalazinone, phthalazinone derivatives or metal salts or these derivatives such as 4-(1-naphthyl)phthalazinone, 6-chlorophthalazinone, 5,7-dimethoxyphthalazinone, and 2,3-dihydro-1,4-phthalazinone; a combination of phthalazinone plus sulfinic acid derivatives, e.g., phthalic acid, 4-methylphthalic acid, 4-nitrophthalic acid, and tetrachlorophthalic anhydride; quinazolinediones, benzoxazine or naphthoxazine derivatives; rhodium complexes functioning not only as tone modifiers but also as sources of halide ion for silver halide formation in situ, such as ammonium hexachloro-rhodate (III), rhodium bromide, rhodium nitrate and potassium hexachloro-rhodate (Ill); inorganic peroxides and persulfates, e.g., ammonium peroxydisulfate and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidines and asymtriazines, e.g., 2,4-dihydroxypyrimidine, 2-hydroxy-4-aminopyrimidine, and azauracil, and tetrazapentalene derivatives, e.g., 3,6-dimercapto-1,4-diphenyl 1H,4H-2,3a,5,6a-tetrazapentalene, and 1,4-di(o-chloro-phenyl)-3,6-dimercapto-1H,4H-2,3a.5.6a-tetrazapentalene.

Silver halide emulsions containing the chromogenic yellow and magenta leuco dyes used in this invention may be protected further against the additional production of fog and can be stabilized against loss of sensitivity during keeping. While not necessary for the practice of the invention, it may be advantageous to add mercury (II) salts to the emulsion layer(s) as an antifoggant. Preferred mercury (II) salts for this purpose are mereuric acetate and mercuric bromide.

Suitable anti-foggants and stabilizers which can be used alone or in combination, include the thiazolium salts described in Stand, U.S. Pat. No. 2,131,038 and Allen U.S. Pat. No. 2,694,716; the azaindenes described in Piper, U.S. Pat. No. 2,886,437 and Heimbach, U.S. Pat. No. 2,444,605; the mercury salts described in Allen, U.S. Pat. No. 2,728,663; the urazoles described in Anderson, U.S. Pat. No. 3,287,135; the sulfocatechols described in Kennard, U.S. Pat. No. 3,235,652; the oximes described in Carrol et al., British Patent No. 623,448; the polyvalent metal salts described in Jones, U.S. Pat. No. 2,839,405; the thiuronium salts described by Herz, U.S. Pat. No. 3,220,839; and palladium, platinum and gold salts described in Trivelli, U.S. Pat. No. 2,566,263 and Damschroder, U.S. Pat. No. 2,597,915.

Stabilized emulsions used in the invention can contain plasticizers and lubricants such as polyalcohols, e.g., glycerin and diols of the type described in Milton, U.S. Pat. No. 2,960,404; fatty acids or esters such as those described in Robins, U.S. Pat. No. 2,588,765 and Duane, U.S. Pat. No. 3,121,060; and silicone resins such as those described in DuPont British Patent No. 955,061.

The photothermographic elements can include image dye stabilizers. Such image dye stabilizers are illustrated by U.K. Patent No. 1,326,889; U.S. Pat. Nos. 3,432,300 and 3,698,909; U.S. Pat. No. 3,574,627; U.S. Pat. No. 3,573,050; U.S. Pat. No. 3,764,337; and U.S. Pat. No. 4,042,394.

Photothermographic elements containing stabilized emulsion layers can be used in photographic elements which contain light absorbing materials and filter dyes such as those described in Sawdey, U.S. Pat. No. 3,253,921; Gaspar U.S. Pat. No. 2,274,782; Carroll et al., U.S. Pat. No. 2,527,583 and Van Campen, U.S. Pat. No. 2,956,879. If desired, the dyes can be mordanted, for example, as described in Milton, U.S. Pat. No. 3,282,699.

Photothermographic elements containing stabilized emulsion layers can contain matting agents such as starch, titanium dioxide, zinc oxide, silica, polymeric beads including beads of the type described in Jelley et al., U.S. Pat. No. 2,992,101 and Lynn, U.S. Pat. No. 2,701,245.

Stabilized emulsions can be used in photothermographic elements which contain antistatic or conducting layers, such as layers that comprise soluble salts, e.g., chlorides, nitrates, etc., evaporated metal layers, ionic polymers such as those described in Minsk, U.S. Pat. Nos. 2,861,056, and 3,206,312 or insoluble inorganic salts such as those described in Trevoy, U.S. Pat. No. 3,428,451.

The photothermographic dry silver emulsions used in the material of this invention may be constructed of one or more layers on a substrate. Two-layer constructions must contain the silver source and silver halide in one emulsion layer (usually the layer adjacent the substrate) and some of the other ingredients in the second layer or both layers. Multicolor photothermographic dry silver constructions contain sets of these bilayers for each color.

The photothermographic elements of this invention may be used to prepare full color images. Multi-layer constructions containing blue-sensitive emulsions containing a yellow leuco dye of this invention may be overcoated with green-sensitive emulsions containing a magenta leuco dye of this invention. These layers may in turn be overcoated with a red-sensitive emulsion layer containing a cyan leuco dye. Imaging and heating form the yellow, magenta, and cyan images in an imagewise fashion. The dyes so formed may migrate to an image receiving layer. The image receiving layer may be a permanent part of the construction or may be removable "i.e., strippably adhered" and subsequently peeled from the construction. Color forming layers may be maintained distinct from each other by the use of functional or non-functional barrier layers between the various photosensitive layers as described in U.S. Pat. No. 4,460,681. False color address, such as that shown in U.S. Pat. No. 4,619,892 may also be used rather than blue-yellow, green-magenta, or red-cyan relationships between sensitivity and dye formation.

The Substrate

Photothermographic emulsions used in the invention can be coated on a wide variety of supports. The support or substrate can be selected from a wide range of materials depending on the imaging requirement. Typical supports include polyester film, subbed polyester film, poly(ethylene terephthalate) film, cellulose nitrate film, cellulose ester film, poly(vinyl acetal) film, polycarbonate film and related or resinous materials, as well as glass, paper, metal and the like. Typically, a flexible support is employed, especially a paper support, which can be partially acetylated or coated with baryta and/or an alphaolefin polymer, particularly a polymer of an alpha-olefin containing 2 to 10 carbon atoms such as polyethylene, polypropylene, ethylenebutene copolymers and the like. Preferred polymefic materials for the support include polymers having good heat stability, such as polyesters. A particularly preferred polyester is polyethylene terephthalate.

Photothermographic emulsions used in this invention can be coated by various coating procedures including, wire wound rod coating, dip coating, air knife coating, curtain coating, or extrusion coating using hoppers of the type described in U.S. Pat. No. 2,681,294. If desired, two or more layers may be coated simultaneously by the procedures described in U.S. Pat. No. 2,761,791 and British Patent No. 837,095. Typical wet thickness of the emulsion layer can range from about 10 to about 100 micrometers (μm), and the layer can be dried in forced air at temperatures ranging from 20° C. to 100° C. It is preferred that the thickness of the layer be selected to provide maximum image densities greater than 0.2, and more preferably in the range 0.5 to 2.5, as measured by a MacBeth Color Densitometer Model TD 504 using the color filter complementary to the dye color.

Alternatively, the formulation may be spray-dried to produce solid particles, which can then be redispersed in a second, possibly different, binder and then coated onto the support.

The formulation for the emulsion layer can also include coating aids such as fluoroaliphatic polyesters.

Barrier layers, preferably comprising a polymeric material, can also be present in the photothermographic element of the present invention. Polymers for the material of the barrier layer can be selected from natural and synthetic polymers such as gelatin, polyvinylalcohols, polyacrylic acids, sulfonated polystyrene, and the like. The polymers can optionally be blended with barrier aids such as silica.

The substrate with backside resistive heating layer may also be used in color photothermographic imaging systems such as shown in U.S. Pat. Nos. 4,460,681 and 4,374,921.

The Image Receiving Layer

Images derived from the photothermographic element are typically transferred to an image-receiving layer. The image-receiving layer of this invention can be any flexible or rigid, transparent layer made of thermoplastic polymer. The image-receiving layer preferably has a thickness of at least 0.1 micrometer, more preferably from about 1 to about 10 micrometers, and a glass transition temperature of from about 20° C. to about 200° C. In the present invention, any thermoplastic polymer or combination of polymers can be used, provided the polymer is capable of absorbing and fixing the dye. Because the polymer acts as a dye mordant, no additional fixing agents are required. Thermoplastic polymers that can be used to prepare the image-receiving layer include polyesters, such as polyethylene terephthalates; polyolefins, such as polyethylene; cellulosics, such as cellulose acetate, cellulose butyrate, cellulose propionate; polystyrene; polyvinyl chloride; polyvinylidine chloride; polyvinyl acetate; copolymer of vinylchloride-vinylacetate; copolymer of vinylidene chloride-acrylonitrile; copolymer of styrene-acrylonitrile; and the like.

The optical density of the dye image and even the actual color of the dye image in the image-receiving layer is very much dependent characteristics on the polymer of the image-receiving layer, which acts as a dye mordant, and, as such, is capable of absorbing and fixing the dyes. A dye image having a reflection optical density in the range of from 0.3 to 3.5 (preferrably from 1.5 to 3.5) or a transmission optical density in the range of from 0.2 to 2.5 (preferrably from 1.0 to 2.5) can be obtained with the present invention.

The image-receiving layer can be formed by dissolving at least one thermoplastic polymer in an organic solvent (e.g., 2-butanone, acetone, tetrahydrofuran) and applying the resulting solution to a support base or substrate by various coating methods known in the art, such as curtain coating, extrusion coating, dip coating, air-knife coating, hopper coating, and any other coating method used for coating solutions. After the solution is coated, the image-receiving layer is dried (e.g., in an oven) to drive off the solvent. The image-receiving layer may be strippably adhered to the photothermographic element. Strippable image receiving layers are described in U.S. Pat. No. 4,594,307, incorporated herein by reference.

Selection of the binder and solvent to be used in preparing the emulsion layer significantly affects the strippability of the image-receiving layer from the photosensitive element. Preferably, the binder for the image-receiving layer is impermeable to the solvent used for coating the emulsion layer and is incompatible with the binder used for the emulsion layer. The selection of the preferred binders and solvents results in weak adhesion between the emulsion layer and the image-receiving layer and promotes good strippability of the emulsion layer.

The photothermographic element can also include coating additives to improve the strippability of the emulsion layer. For example, fluoroaliphatic polyesters dissolved in ethyl acetate can be added in an amount of from about 0.02 to about 0.5 weight percent of the emulsion layer, preferably from about 0.1 to about 0.3 weight percent. A representative example of such a fluoroaliphatic polyester is "Fluorad FC 431", commercially available from Minnesota Mining and Manufacturing Co. Alternatively, a coating additive can be added to the image-receiving layer in the same weight range to enhance strippability. No solvents need to be used in the stripping process. The strippable layer preferably has a delaminating resistance of 1 to 50 g/cm and a tensile strength at break greater than, preferably at least two times greater than, its delaminating resistance.

Preferably, the image-receiving layer is adjacent to the emulsion layer to facilitate transfer of the dye that forms after the imagewise exposed emulsion layer is subjected to thermal development, for example, in a heated shoe and roller type heat processor.

In another embodiment, the colored dye released in the emulsion layer can be transferred onto a separately coated image-receiving sheet by placing the exposed emulsion layer in intimate face-to-face contact with the image-receiving sheet and heating the resulting composite construction. Good results can be achieved in this second embodiment when the layers are in uniform contact for a period of time of from 0.5 to 300 seconds at a temperature of from about 80° C. to about 220° C.

Multi-color images can be prepared by superimposing in register, imaged image-receiving layers as prepared above. The polymers of the individual imaged image-receiving layers must be sufficiently adherent to provide useful multi-color reproduction on a single substrate.

Development conditions will vary, depending on the construction used, but will typically involve heating the imagewise exposed material at a suitably elevated temperature, e.g. from about 80° C. to about 250° C., preferably from about 120° C. to about 200° C., for a sufficient period of time, generally from 1 second to 2 minutes.

In some methods, the development is carried out in two steps. Thermal development takes place at a higher temperature, e.g. about 150° C. for about 10 seconds, followed by thermal diffusion at a lower temperature, e.g. 80° C., in the presence of a transfer solvent. The second heating step at the lower temperature prevents further development and allows the dyes that are already formed to diffuse out of the emulsion layer.

The material of this invention can be used for example, in conventional color photography, in electronically generated color hardcopy recording, and in digital color proofing in the graphic arts area. The material of this invention provides high photographic speed, provides pure dye images, and provides a dry and rapid process.

Objects and advantages of this invention will now be illustrated by the following examples, but the particular materials and amounts thereof recited in these examples, as well as other conditions and details, should not be construed to unduly limit this invention. All percentages are by weight unless otherwise indicated.

The present invention will be illustrated in detail in reference to the following examples, but the embodiment of the present invention is not limited thereto.

EXPERIMENTAL EXAMPLES

Preparation of Yellow and Magenta Leuco Dyes

Preparation of Magenta Leuco Dye B

To 2.50 g (2.90 mmol) of azomethine chromogenic magenta dye prepared by oxidative coupling of Coupler A and Developer A in 150 ml of tetrahydrofuran was added 10% palladium on carbon. The mixture was hydrogenated at 2 atm pressure for 50 min and a colorless solution resulted. 4-(N,N-Dimethylamino)phenylisocyanate (0.94 g, 5.80 mmol) was added and stirring was continued overnight at room temperature. Filtration to remove the palladium on carbon was followed by solvent removed in vacuo to afford the crude product. Purification was achieved by chromatography on silica gel and elution with ethyl acetate/petroleum ether to give desired leuco dye B.

Preparation of Magenta Leuco Dyes A, C, D, E, F, H, and J

Magenta leuco dyes A, C, D, E, F, H, AND J were prepared according to the synthetic procedure described for magenta leuco dye B. This involved hydrogenation of the dye, trapping with an isocyanate derivative, and purification by chromatography.

Preparation of Yellow Chromogenic Leuco Dye G

Coupler F (5.65 g, 20.98 mmol) was stirred vigorously for 15 minutes with 300 ml dichloromethane. Blocked developer 1-n-butyl-3-(4'-N,N-diethylamino)phenyl urea (5.194 g 19.72 mmol) was ground to a fine powder in a mortar and added to the reaction mixture. A solution of sodium carbonate (40 g, 378.94 mmol) in 800 ml of water was prepared. A solution of potassium ferrocyanide (15.08 g, 35.70 mmol) and potassium ferricyanide (1.32 g, 4.0 mmol) in 200 ml water was prepared. The sodium carbonate solution was added to the reaction mixture and the dropwise addition of the potassium ferrocyanide/potassium ferricyanide solution was begun immediately and continued over a 15 minute period. The mixture was stirred an additional 15 minutes and potassium ferricyanide (1.32 g, 4.0 mmol) was added. The mixture was stirred an additional 20 minutes and potassium ferricyanide (2.6 g, 8.0 mmol) was added. The mixture was stirred an additional 25 minutes and potassium ferricyanide (2.6 g, 8.0 mmol) was added. The mixture was stirred an additional 25 minutes and potassium ferricyanide (2.6 g, 8.0 mmol) was again added. The aqueous phase was separated and the organic phase was washed twice with saturated sodium chloride solution. The organic phase was dried over magnesium sulfate, filtered and the solvent was removed in vacuo. The crude product residue was purified by chromatography on a Waters Prep 500 HPLC using a 4:1 dichloromethane/ethyl acetate solvent system to give yellow leuco dye G contaminated with some 3-butyl-1-[4'-N,N-diethylamino-2'-(2-benzoyl-o-methoxyacetanilidyl)]phenyl urea.

Preparation of Yellow Chromogenic Leuco Dye K

Yellow leuco dye K was prepared from Coupler F and 1-(4-N,N-diethyl-amino)phenyl-3-(4'-N,N-dimethylamino)phenyl urea according to the synthetic procedure described above for yellow leuco dye G. Compound G is a mixture of two isomers.

Test For The Presence of Leuco Dyes

All of the above magenta and yellow leuco dyes gave the corresponding magenta and yellow dyes when subjected to the following test conditions:

The leuco dyes were chromatographed on thin layer silica gel chromatography plates using ethyl acetate/petroleum ether or dichloromethane/ethyl acetate solvent systems. Following development, the plates were placed in a 5% aqueous sodium carbonate solution for approximately five seconds and then placed in a 3% aqueous potassium ferricyanide solution for approximately five seconds. The plates were rinsed under water. Following this treatment the initially colorless leuco dye spot on the silica gel plate was converted to a magenta or yellow color.

Preparation of "Dry Silver" Photothermographic Formulations

Formulation A—A dispersion of silver behenate half soap was homogenized to 10% solids in ethanol and toluene with 0.5% polyvinylbutyral (Butvat™-72). To 205 g of the silver half soap dispersion was added 285 g of ethanol. After 10 minutes of mixing, 6.0 ml of a mercuric bromide solution (0.36g/20 ml methanol) was added. This was followed 3 hr later by the addition of 8.0 ml of a zinc bromide solution (0.45 g/20 ml methanol). After 1 hour of mixing 26 g of polyvinylbutyral (Butvar™ B-72 availible from Monsanto, St. Louis, Mo.) was added. After 1 hour, fluorocarbon surfactant FC431 (1.0 g/10.0 ml methanol—available from 3M Company, St. Paul Minn.) was added. To 64.2 g of this silver premix was added 4.0 ml of sensitizing dye D1 (0.090 g/100 ml methanol) shown below.

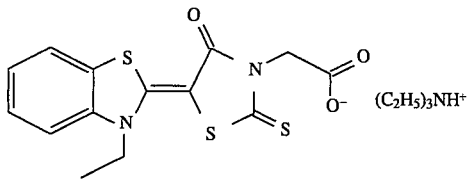

D1

After 30 minutes, the chromogenic leuco developer solution was added to a 8.43 g aliquot of the sensitized silver premix. The leuco developer solution is shown below.

| Component | Amount |
|---|---|
| Leuco Dye | $1.365 \times 10^{-4}$ mol |
| Tetrahydrofuran | 1.5 ml |

A topcoat solution was prepared containing 5.9% cellulose acetate, 1.33% Rohm and Haas Acryloid A-21, in an acetone, isopropyl alcohol and methanol 1.0 mixture (11.67:2.72:1). The topcoat may contain toners such as 0.417% phthalazinone; 0.1% 4-methyl-phthalic acid (4MPA); or a mixture of 0.352% phthalazine (PHZ), 0.19% 4-methyl-phthalic acid and 0.186% tetrachlorophthalic anhydride (TCPAN). If the topcoat contained PAZ toner than the silver premix also contained PAZ (0.035 g to 8.43g of sensitized silver premix.)

A receptor coating of 15% VYNS (polyvinylchloride/polyvinylacetate in methylethylketone and toluene (50/50) solution) may also be prepared and coated with both formulations.

For Formulation A all layers were coated at 3 mils wet thickness on a filled polyester base and dried for 4 minutes at 180° F. (82° C.). The samples were exposed using an EG&G Sensitometer for $10^{-3}$ seconds with a xenon flash through a 47B Wratten filter and a 0 to 3 continuous wedge. The coatings were processed at dwell temperature of 240° F.–280° F. and dwell times 5–40 seconds using a heat blanket or a roll processor.

Formulation B— A dispersion of silver behenate half soap was made at 10% solids in toluene and ethanol by homogenization. To 153.9 g of this silver half soap dispersion was added 253.3 g of methylethyl ketone, 115.16 g isopropanol and 0.74 g of poly-vinyl-butyral. After 15 minutes of mixing, 0.98 g of a 12% pyridine solution in methylethyl ketone and 5 ml of mereuric bromide (0.36 gt10 mL ethanol) were added. This was followed 30 min later by addition of 10.0 ml of calcium bromide (0.236 g/10 ml ethanol). After 3 hr of mixing, 25.72 g of polyvinylpyrolidone was added. After 1 hr, 34.3 g of polyvinylbutyral was added.

To 20.54 g of the prepared silver premix described above was added 1.39 ml of the sensitizing dye D1 (0.045 g/58.26 g of ethanol and 19.42 g of toluene) shown below.

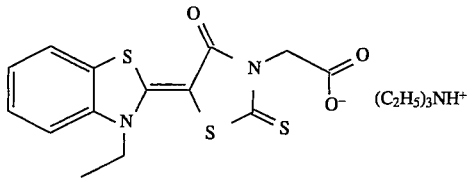

After 20 min, 4.3 g of the silver premix with sensitizing dye was added to the following composition:

| Component | Amount |
|---|---|
| Leuco Dye | $6.96 \times 10^{-5}$ mol |
| Phthalazinone | 0.23 g |
| Methanol | 0.55 ml |
| Tetrahydrofuran | 0.50 ml |

The resulting solution was coated onto a polyester base at a wet thickness of 3 mils (76 μm) and dried at 85° C. for 5 min. A topcoat solution was coated over the silver halide layer at a wet thickness of 3 mils (76 μm) and dried at 85° C. for 5 min. The topcoat solution consisted of 7.5% polyvinyl alcohol and $2.0 \times 10^{-}$% benzotriazole in an approximate 50:50 mixture of water and methanol. When all particles were dissolved, 0.035 g of sodium acetate or 0.43 ml of a 1.0N sodium hydroxide solution were added to 10.0 g of the solution and the topcoat was stirred for an additional hour.

The following examples demonstrate the imaging capabilities of the leuco dyes of the present invention.

EXAMPLE 1

To 8.43 g of Formulation A, was added $1.365 \times 10^{-4}$ mol of leuco magenta dye B. The solution was coated as described above and overcoated with several different topcoat solutions. The topcoated samples were processed from 250°–280° F. for 5 to 12 seconds. The sensitometric response is shown below.

| Toner | Processing Conditions | Dmin | Dmax | Speed | Contrast | L | a* | b* |
|---|---|---|---|---|---|---|---|---|
| PAZ | 5 sec at 280° F. | R 0.14 | 0.60 | — | — | 51.0 | 26. | −24.9 |
| | | G 0.23 | 1.16 | 2.29 | — | | | |
| | | B 0.13 | 0.61 | — | — | | | |
| | 10 sec at 280° F. | R 0.23 | 0.94 | 2.37 | — | | | |
| | | G 0.48 | 1.91 | 1.80 | 2.00 | | | |
| | | B 0.24 | 1.14 | 2.32 | — | | | |
| 4-MPA/ PHZ/TCPAN | 12 sec at 250° F. | R 0.12 | 1.19 | 2.07 | — | 49.3 | 24. | −23.1 |
| | | G 0.21 | 1.88 | 1.85 | 2.56 | | | |
| | | B 0.14 | 1.11 | 2.15 | | | | |
| | 6 sec at 275° F. | R 0.14 | 1.34 | 1.91 | — | | | |
| | | G 0.26 | 1.90 | 1.57 | 1.78 | | | |
| | | B 0.15 | 1.28 | 1.96 | — | | | |

Under all processing conditions, photothermographic reduction of silver and oxidization of the leuco dye to magenta dye was observed. The λmax for the magenta color was 568 nm.

Leuco magenta dye B, in the silver formulation of Formulation A was also coated with a variety of topcoats onto a VYNS receptor layer. The samples were measured with donor and receptor layers attached (Donor+Receptor) before stripping and after the donor layer was stripped (Receptor). The sensitometric responses are shown below. In all samples a photothermographic reduction of silver and oxidation of the leuco dye formed a magenta dye that was transferred by diffusion to a receptor layer.

| Toner | Processing Conditions | Donor + Receptor Dmin | Dmax | Speed | Contrast | Receptor Dmin | Dmax |
|---|---|---|---|---|---|---|---|
| PAZ | 10 sec at 280° F. | R 0.22 | 0.35 | — | — | 0.10 | 0.13 |
| | | G 0.42 | 0.68 | — | — | 0.17 | 0.23 |
| | | B 0.20 | 0.31 | — | — | 0.05 | 0.07 |
| | 10 sec (no filter used) 280° F. | R 0.13 | 0.46 | — | — | 0.09 | 0.13 |
| | | G 0.30 | 0.90 | — | — | 0.12 | 0.28 |
| | | B 0.18 | 0.41 | — | — | 0.04 | 0.09 |
| 4-MPA | 12 sec at 250° F. | R 0.15 | 0.48 | — | — | 0.09 | 0.13 |
| | | G 0.23 | 0.81 | — | — | 0.11 | 0.22 |
| | | B 0.16 | 0.79 | — | — | 0.06 | 0.08 |
| | 6 sec at 275° F. | R 0.27 | 0.79 | — | — | 0.11 | 0.23 |
| | | G 0.44 | 1.43 | 2.18 | — | 0.17 | 0.46 |
| | | B 0.23 | 0.63 | — | — | 0.07 | 0.15 |
| 4-MPA/ PAZ/TCPAN | 12 sec at 250° F. | R 0.10 | 0.39 | — | — | 0.08 | 0.11 |
| | | G 0.19 | 0.72 | — | — | 0.11 | 0.16 |
| | | B 0.12 | 0.41 | — | — | 0.06 | 0.12 |
| | 6 sec at 275° F. | R 0.13 | 0.70 | — | — | 0.09 | 0.13 |
| | | G 0.24 | 1.49 | 1.65 | 0.88 | 0.14 | 0.26 |
| | | B 0.16 | 0.65 | — | — | 0.07 | 0.10 |

EXAMPLE 2

To 8.43 g of Formulation A, was added $1.365\times10^{-4}$ mol of leuco magenta dyes C or D. The solutions weres coated as described above and overcoated with several different toner-containing topcoat solutions. The topcoated samples were processed from 250°–280° F. for 5 to 12 seconds. The sensitometric response is shown below. Under all processing conditions, photothermographic reduction of silver and oxidization of the leuco dye to magenta dye was observed. The λmax for the magenta color was 532 nm.

| Toner | Processing Conditions | Dmin | Dmax | Speed | Contrast | L | a* | b* |
|---|---|---|---|---|---|---|---|---|
| | | | Dye C | | | | | |
| PAZ | 6 sec at 275° F. | G 0.14 | 0.88 | 2.10 | — | — | — | — |
| PAZ | 10 sec at 280° F. | G 0.19 | 1.05 | 1.62 | — | — | — | — |
| PHZ/ | 6 sec at 250° F. | G 0.11 | 0.98 | 2.00 | — | — | — | — |
| 4-MPA/ TCPAN | 6 sec at 275° F. | G 0.19 | 1.11 | 1.59 | 0.33 | — | — | — |
| 4-MPA | 10 sec at 280° F. | G 0.19 | 1.20 | 2.10 | 1.22 | 42.7 | 19.2 | −22.4 |
| | | | Dye D | | | | | |
| PAZ | 6 sec at 275° F. | G 0.21 | 1.50 | 1.82 | 1.34 | 48.3 | 16.6 | −13.4 |
| PHZ/ 4-MPA TCPAN | 6 sec at 250° F. | G 0.39 | 1.66 | 1.58 | 0.80 | — | — | — |
| 4-MPA | 6 sec at 275° F. | G 0.34 | 1.42 | 2.32 | 1.25 | — | — | — |

EXAMPLE 3

To 8.43 g of Formulation A, was added $1.365\times10^{-4}$ mol of leuco magenta dye E. The solution was coated as described above and overcoated with a PHZ/4MPA/TCPAN topcoat onto a receptor layer. The topcoated samples were processed from 240°–250° F. for 6 to 18 seconds. The sensitometric response is shown below. In these samples, a magenta image was formed by photothermographic reduction of silver and oxidation of the magenta leuco to the magenta dye.

| Processing Conditions | Dmin | Dmax | Speed |
|---|---|---|---|
| 6 sec at 250° F. | R 0.25 | 0.39 | — |
| | G 0.54 | 0.79 | 2.47 |
| | B 0.32 | 0.50 | — |
| 12 sec at 250° F. | R 0.27 | 0.58 | 2.08 |
| | G 0.58 | 1.07 | 1.78 |
| | B 0.35 | 0.69 | 2.07 |

EXAMPLE 4

To 8.43 g of Formulation A, was added $1.365\times10^{-4}$ mol of leuco magenta dye F. The solution was coated as described above and overcoated with a PAZ or a PHZ/4MPA/TCPAN topcoat onto a receptor layer. The topcoated samples were processed from 260°–280° F. for 6 to 10 seconds. The sensitometric response is shown below. In these samples, a magenta image was formed by photothermographic reduction of silver and oxidation of the magenta leuco to the magenta dye.

| Toner | Processing Condition | Doner & Receptor Dmin | Dmax | Speed | Contrast | Receptor Dmin | Dmax | Speed |
|---|---|---|---|---|---|---|---|---|
| PHZ/4MPA/TCPAN | 6 sec at 260° F. | G .18 | 2.03 | 1.79 | 2.18 | 0.11 | 0.61 | — |
| | 6 sec 275° F. | G .23 | 2.38 | 1.16 | 1.21 | 0.12 | 1.16 | 2.35 |
| | 10 sec 280° F. | G .45 | 2.39 | 0.60 | 2.26 | 0.18 | 1.65 | 1.53 |
| PAZ | 6 sec 260° F. | G .21 | .90 | 2.74 | — | 0.11 | .24 | — |
| | 6 sec 275° F. | G .25 | 2.38 | 1.74 | 2.18 | 0.13 | .93 | 2.78 |
| | 10 sec 280° F. | G .31 | 2.32 | 1.42 | 3.29 | 0.15 | 1.58 | 2.08 |

EXAMPLE 5

To 4.3 g of Formulation B, was added $6.96\times10^{-5}$ mol of leuco magenta dye A. The solution was coated as described above and overcoated with a sodium acetate topcoat solution. The topcoated sample were processed at 140° C. for 24 seconds and exposed using an EG&G sensitometer for $8\times10^{-3}$ seconds with a xenon flash through a 47B Wratten filter and a 0 to 3 continuous wedge. In these samples, a magenta image with a λmax of 550.4 nm was formed by photothermographic reduction of silver and oxidation of the magenta leuco to the magenta dye. The sensitometeric response is shown below.

| Sample | Dmin | Dmax |
|---|---|---|
| A | 0.35 | 1.02 |

EXAMPLE 6

As described in Formulation B, $6.96\times10^{-5}$ mols of G was added to 4.3 g of the silver coating solution.

The solution was coated as described above and overcoated with a sodium hydroxide topcoat solution. The topcoated sample were processed at 140° C. for 6 seconds and exposed using an EG&G sensitometer for either $4\times10^{-3}$ seconds or $8\times10^{-3}$ seconds with a xenon flash through a 47B Wranen filter and a 0 to 3 continuous wedge. In these samples, a yellow image was formed by photothermographic reduction of silver and oxidation of the yellow leuco dye to the yellow dye. The sensitometeric response is shown below.

| Sample | Exposure Time | Dmin | Dmax | Speed |
|---|---|---|---|---|
| Dye G | $4\times10^{-3}$ seconds | R 0.16 | 0.25 | — |
| | | G 0.21 | 0.44 | — |
| | | B 0.26 | 0.83 | — |
| Dye G | $8\times10^{-3}$ seconds | R 0.17 | 0.34 | — |
| | | G 0.23 | 0.70 | — |
| | | B 0.31 | 1.32 | 2.29 |

All contrast numbers correspond to the slope of the line joining the density points of 0.6 and 1.2 above Dmin. In Example 2, the contrast number corresponds to the slope of the line joining the density points of 0.3 and 0.9 above Dmin. All speed numbers correspond to the log exposure (in ergs per square era) at a density of 0.6 above Dmin. In Example 3 this speed number corresponds to log exposure at a density of 0.2 above Dmin.

We claim:

1. A yellow forming or magenta forming leuco dye reducing agent comprising a chromogenic leuco dye compound of the general formula:

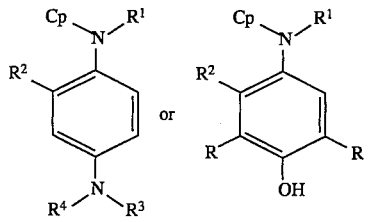

wherein

R is hydrogen or halogen;

$R^1$ is a —CONH—$R^5$ group, a —CO—$R^5$ group or a —CO—O—$R^5$ group, and $R^5$ is an alkyl group of from 1 to 20 carbon atoms, a ballasting group, or an aryl group of from 6 to 30 carbon atoms;

$R^2$ is a hydrogen atom or an alkyl group of from 1 to 4 carbon atoms;

$R^3$ and $R^4$ are each independently selected from, a hydrogen atom, an alkyl group of from 1 to 4 carbon atoms, a —X—Y group, wherein X is an alkylene group of from 1 to 4 carbon atoms, and Y is a cyano group, a halogen atom, —OH or a —$NHSO_2$—Z group, wherein Z is an alkyl group of from 1 to 20 carbon atoms; and Cp is a yellow or magenta photographic coupler group.

2. A leuco dye reducing agent of claim 1 wherein the leuco dye is represented by the general formula:

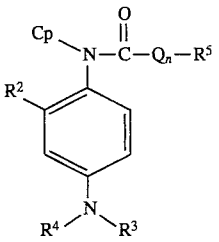
III
wherein $R^2$, $R^3$, $R^4$, $R^5$ and Cp have the same meaning as defined in formula (I);
Q is —NH— or —O—;
and n is 0 or 1.
3. A leuco dye reducing agent of claim 1 wherein the chromogenic yellow or magenta leuco dye is represented by the general formula:
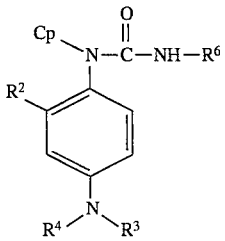
IV
wherein $R^6$ is an alkyl group of up to 8 carbon atoms, an organic ballasting group, or an aryl group of up to 30 carbon atoms.
* * * * *